US007121043B2

(12) United States Patent
Yokota

(10) Patent No.: US 7,121,043 B2
(45) Date of Patent: Oct. 17, 2006

(54) ACTUATING DEVICE FOR OPEN/CLOSE MEMBER OF VEHICLE

(75) Inventor: Yoshiaki Yokota, Kanagawa (JP)

(73) Assignee: Ohi Seisakusho Co., Ltd., Yokohama (JP)

( * ) Notice: Subject to any disclaimer, the term of this patent is extended or adjusted under 35 U.S.C. 154(b) by 356 days.

(21) Appl. No.: 10/833,040

(22) Filed: Apr. 28, 2004

(65) Prior Publication Data

US 2005/0001447 A1 Jan. 6, 2005

(30) Foreign Application Priority Data

May 30, 2003 (JP) ..... 2003-153771

(51) Int. Cl.
*E05F 15/10* (2006.01)
*E05F 15/16* (2006.01)

(52) U.S. Cl. ..... 49/340; 49/349

(58) Field of Classification Search ..... 49/340, 49/349, 352, 339, 341, 342, 336, 344; 74/89.14, 74/89.13, 89.17; 296/56, 146.4, 146.8, 146.1
See application file for complete search history.

(56) References Cited

U.S. PATENT DOCUMENTS 6,367,199 B1 * 4/2002 Sedlak et al. ..... 49/340
6,382,706 B1 * 5/2002 Yuge et al. ..... 296/146.4
6,453,614 B1 * 9/2002 Rogers et al. ..... 49/340
6,513,859 B1 * 2/2003 Yuge ..... 296/146.4
6,550,839 B1 * 4/2003 Rogers et al. ..... 296/56
6,637,157 B1 * 10/2003 Dombrowski et al. ..... 49/341
6,767,048 B1 * 7/2004 Yokota ..... 296/146.4
6,776,443 B1 * 8/2004 Shimura et al. ..... 296/56
6,799,790 B1 * 10/2004 Sakai et al. ..... 296/146.8
6,834,463 B1 * 12/2004 Fukumoto et al. ..... 49/341
6,891,344 B1 * 5/2005 Sakai et al. ..... 318/280
6,929,310 B1 * 8/2005 Okada ..... 296/146.8
6,964,449 B1 * 11/2005 Takeda et al. ..... 296/146.4
7,014,248 B1 * 3/2006 Yokota et al. ..... 296/146.4
7,017,973 B1 * 3/2006 Sera et al. ..... 296/146.1
7,021,003 B1 * 4/2006 Daniels et al. ..... 49/340
7,021,004 B1 * 4/2006 Ritter ..... 49/340

FOREIGN PATENT DOCUMENTS

JP 2001-253241 A 9/2001

* cited by examiner

*Primary Examiner*—Hugh B. Thompson, II
(74) *Attorney, Agent, or Firm*—Foley & Lardner LLP

(57) ABSTRACT

A connecting rod is provided with a bent portion in a substantially middle part thereof so that a lower section of the connecting rod below the substantially middle part in a vertical direction may be inclined, with respect to the longitudinal direction of a guide rail, toward a center of an opening, and at the same time, an upper section of the connecting rod above the substantially middle part may be substantially in parallel to the longitudinal direction of the guide rail and offset from a side face of the guide rail directed to the center of the opening toward the center of the opening, when the connecting rod is in a position corresponding to a closed position of an open/close member.

2 Claims, 7 Drawing Sheets

ACTUATING DEVICE FOR OPEN/CLOSE MEMBER OF VEHICLE

The present application is based on Japanese Patent Application No. 2003-153771, the entire contents of which are incorporated herein by reference.

BACKGROUND OF THE INVENTION

1. Field of the Invention

The present invention relates to a actuating device for an open/close member of a vehicle.

2. Related Art

In a conventional actuating device for an open/close member of a vehicle, on each of vehicle pillars formed at both sides of an opening in a back part of a vehicle body which is adapted to be opened or closed by a rear gate which is pivotally mounted to a back end part of a vehicle roof by means of a substantially horizontal hinge shaft, there are provided a guide rail which is fixed to the vehicle body pillar in such a posture as inclined toward a center of the opening, a rack which is guided by the guide rail in a vertical direction, that is, in a longitudinal direction of the guide rail, a motor unit for moving the rack in the vertical direction, and a connecting rod extending in a vertical direction which is connected at its upper end to the rear gate by means of a universal joint, and connected at its lower end to the rack by means of a universal joint. The rack is moved in the vertical direction along the longitudinal direction of the guide rail thereby to displace the rear gate from a closed position to an open position or from the open position to the closed position (See Japanese Patent Application No. JP-A-2001-253241, for example).

In the actuating device for the open/close member of the vehicle as described above, the opening formed in the back part of the vehicle is generally in a trapezoidal shape. For this reason, it has been necessary to arrange the guide rail for guiding the connecting rod at such a position that it may protrude from the vehicle pillar toward the opening to a large extent, so that a part of the connecting rod may not interfere with a side edge of the vehicle pillar which defines the opening, on occasion of moving the connecting rod for displacing the rear gate to the open position. In case where the guide rail has been arranged in this manner, the guide rail will protrude from the vehicle body pillar toward the opening to a large extent, when the rear gate is opened, which results in a problem that an appearance of the vehicle may be deteriorated and an opening width of the opening may be made narrow.

SUMMARY OF THE INVENTION

In view of the above described problem of the related art, an object of the invention is to provide an actuating device for an open/close member of a vehicle which will not make an opening width of an opening in the vehicle narrow, and will be excellent in quality.

According to the invention, the above described problem will be solved in the following manner.

(1) In an actuating device for an open/close member of a vehicle which is pivotally mounted to an end part of a vehicle roof by means of a substantially horizontal hinge shaft and adapted to open and close an opening of the aforesaid vehicle, by displacing the open/close member from a closed position to an open position or from the open position to the closed position, the aforesaid device being provided on a vehicle body pillar provided at each side edge of the aforesaid opening, and including a guide rail which is arranged in such a posture that a longitudinal direction of the guide rail is inclined toward a center of the opening, a rack which is guided along the longitudinal direction of the guide rail, a motor unit for moving the rack along the longitudinal direction of the guide rail, and a connecting rod which is connected at its upper end to the aforesaid open/close member by means of a universal joint and connected at its lower end to the aforesaid rack by means of a universal joint, the aforesaid connecting rod is provided with a bent portion in a substantially middle part thereof so that a lower section of the aforesaid connecting rod below the substantially middle part in a vertical direction may be inclined, with respect to the longitudinal direction of the aforesaid guide rail, toward the center of the aforesaid opening, and at the same time, an upper section of the aforesaid connecting rod above the substantially middle part may be substantially in parallel to the longitudinal direction of the aforesaid guide rail and offset from a side face of the aforesaid guide rail directed to the center of the aforesaid opening toward the center of the aforesaid opening, when the aforesaid connecting rod is in a position corresponding to the closed position of the aforesaid open/close member.

(2) In the device as described in the above item (1), an upper end part of the guide rail is fixed to the vehicle body pillar, and a lower end part thereof is similarly fixed to the motor unit which is fixed to the aforesaid vehicle body pillar.

DETAILED DESCRIPTION OF THE PREFERRED EMBODIMENTS

Figure 1:
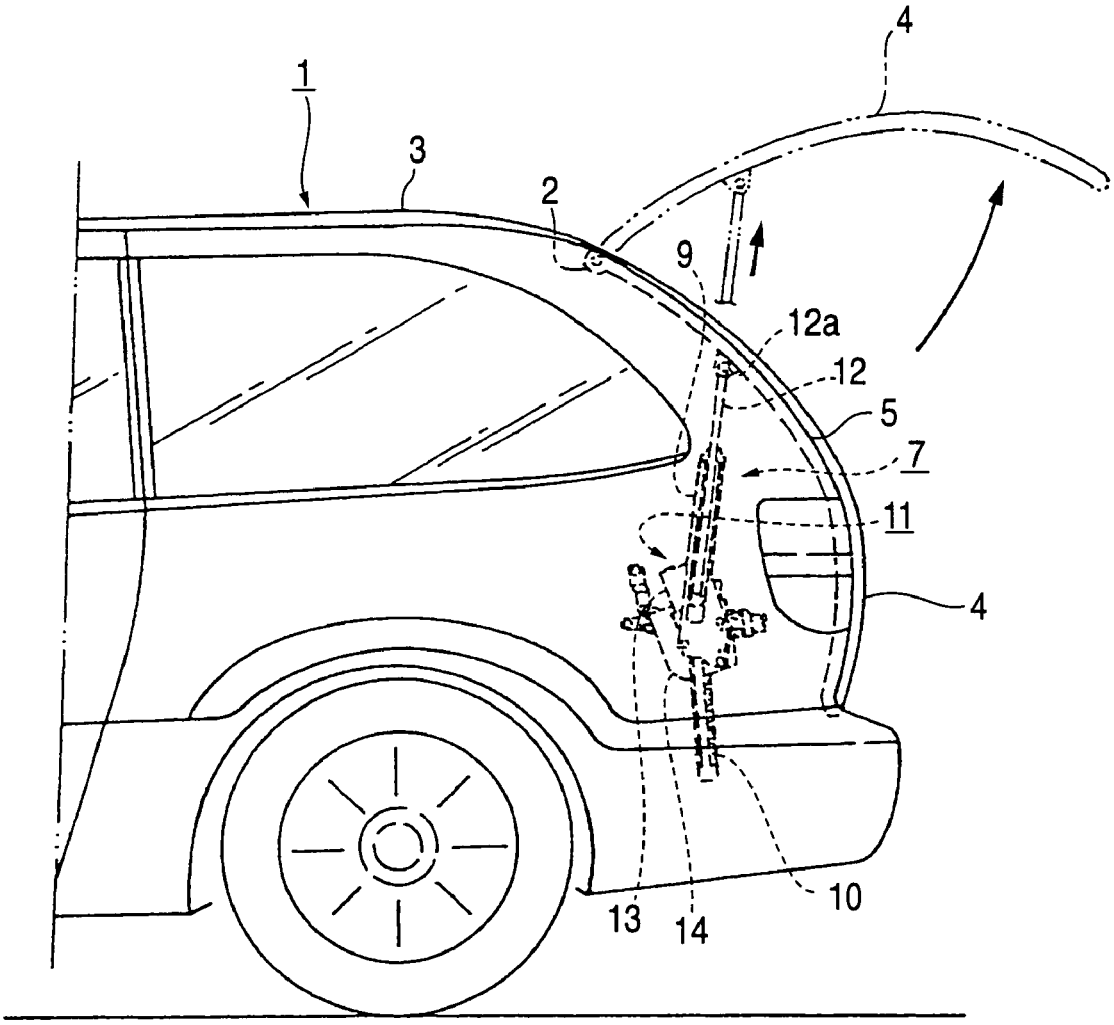
FIG. 1 is a side view of a back part of a vehicle showing a general structure of an embodiment of the invention.

Now, an embodiment of the invention will be described referring to the drawings.

Figure 2:
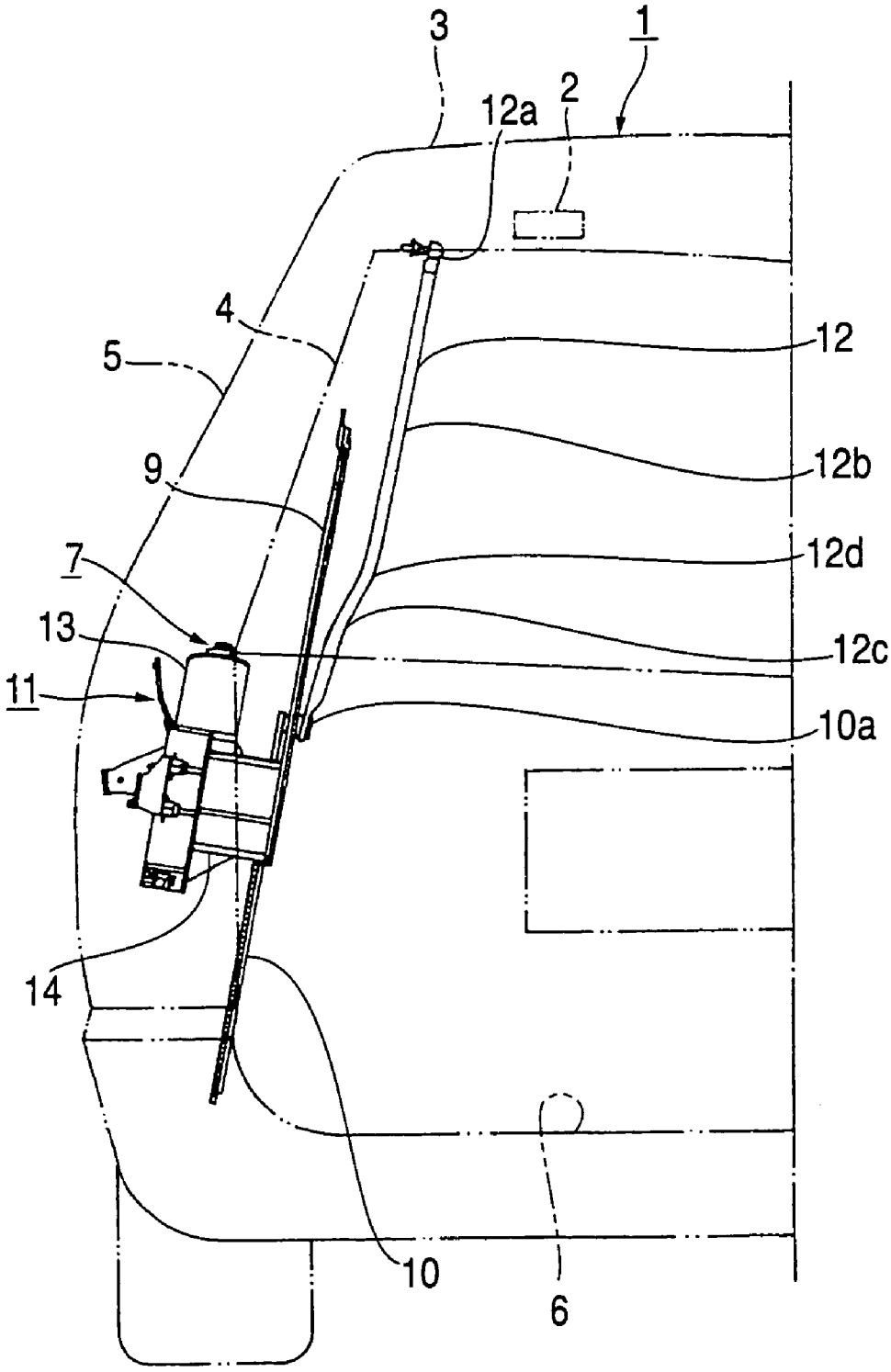
FIG. 2 is a back view showing a left half of the back part of the vehicle when an open/close member is in a closed state.
Figure 3:
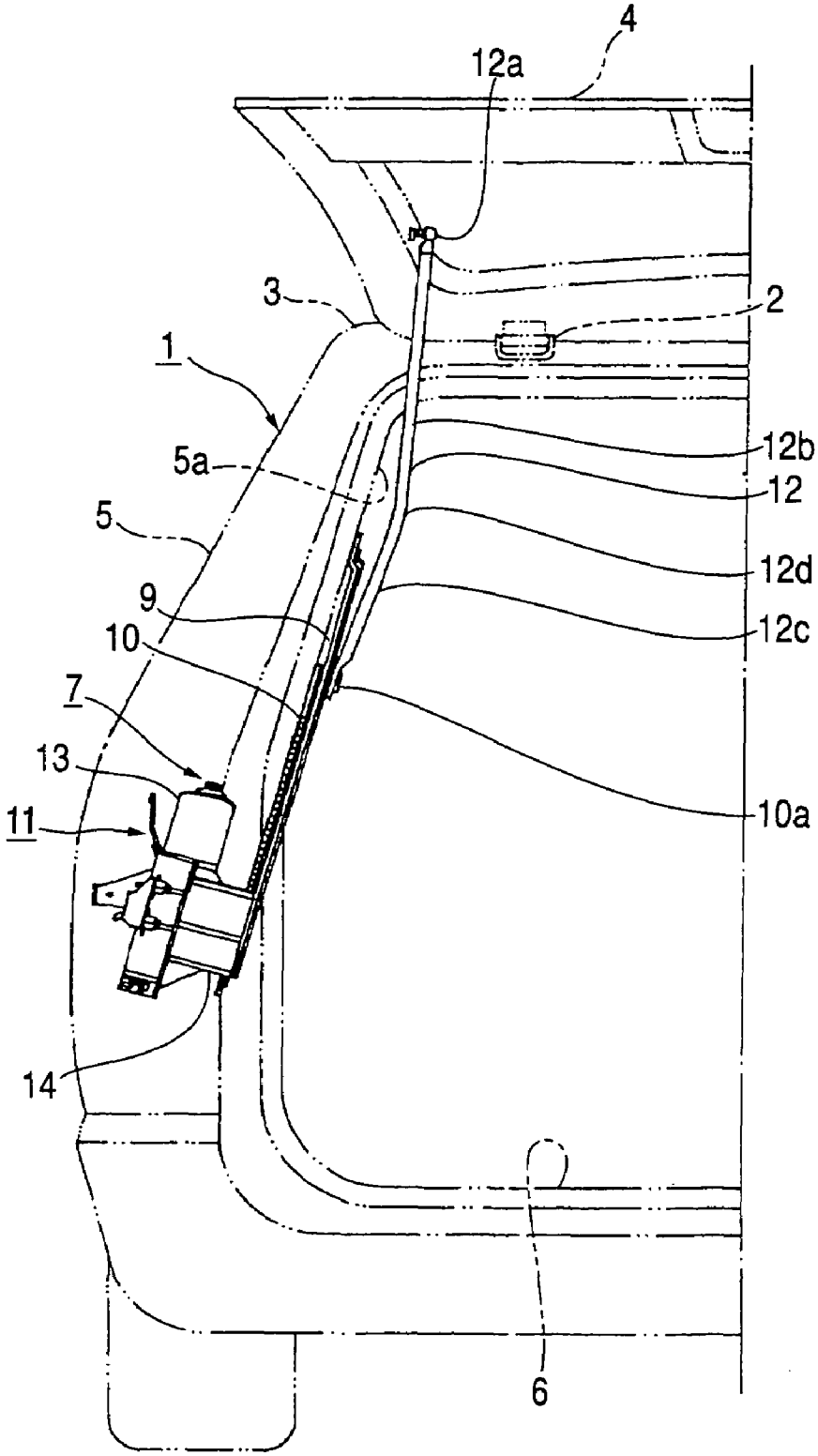
FIG. 3 is a back view showing the left half of the back part of the vehicle when the open/close member is in an open state.
Figure 4:
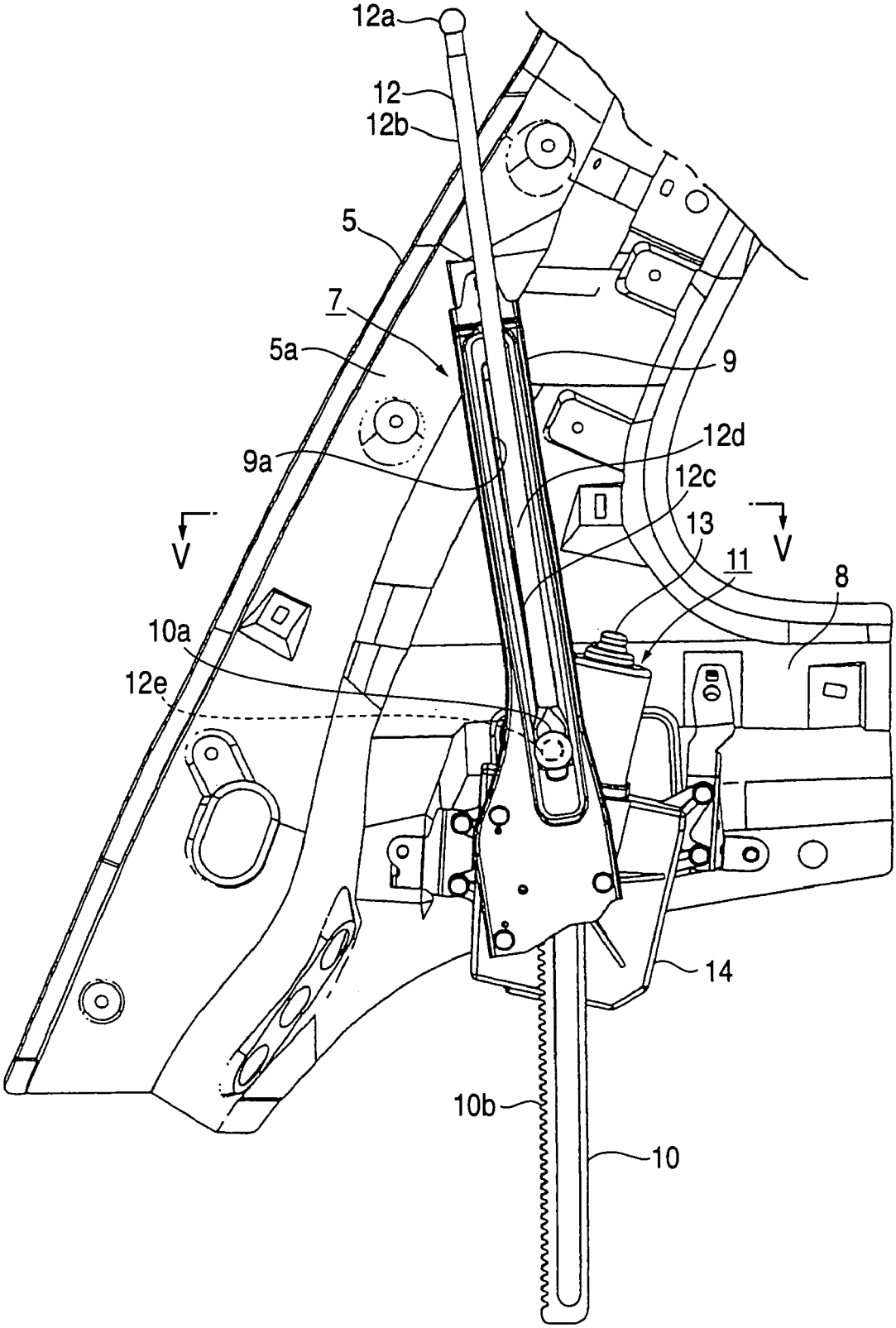
FIG. 4 is a side view of the actuating device as seen from an inside of the vehicle.
Figure 5:
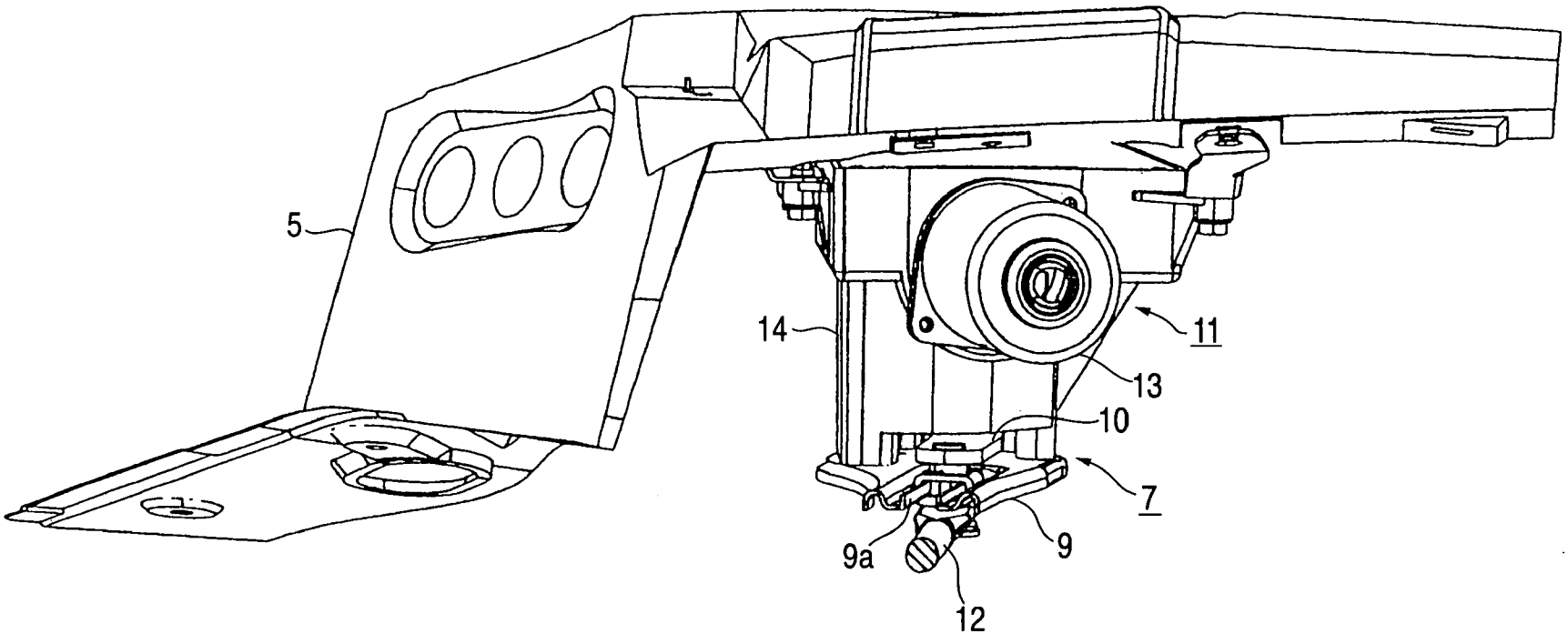
FIG. 5 is a cross sectional view taken along a line V-V in FIG. 4.
Figure 6:
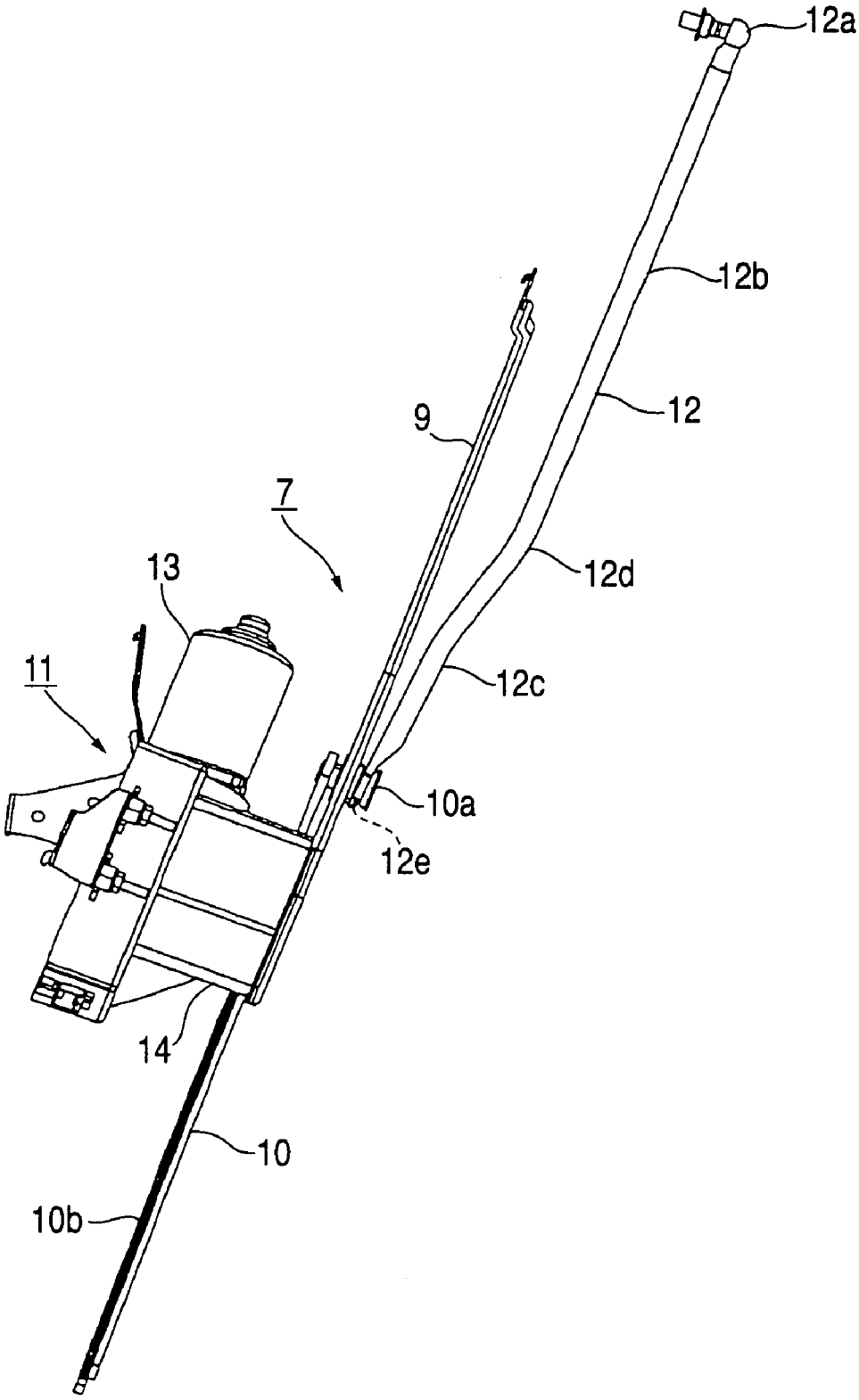
FIG. 6 is a back view of the actuating device, when the connecting rod is in the lower position corresponding to the closed position of the open/close member.
Figure 7:
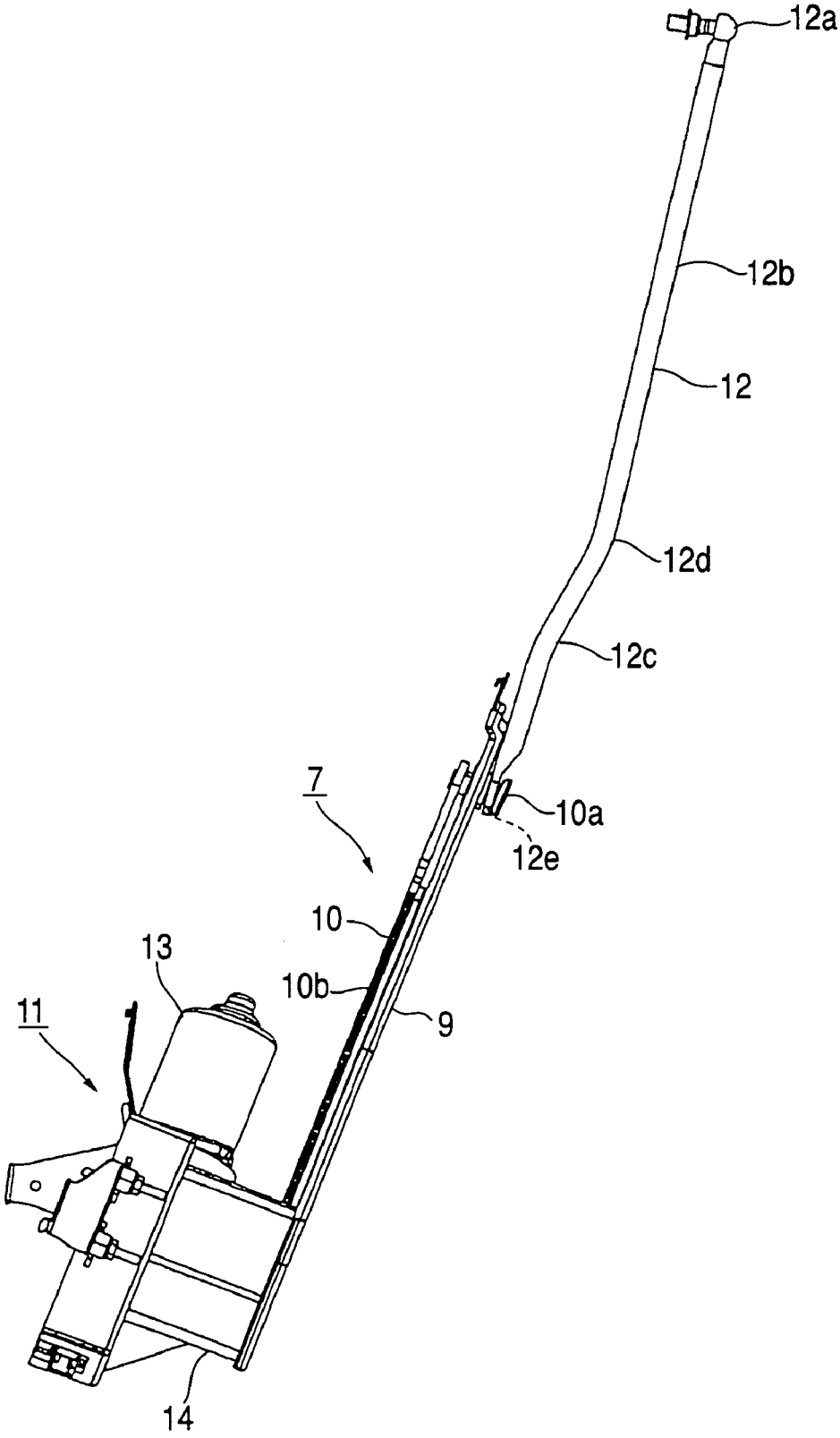
FIG. 7 is a back view of the actuating device, when the connecting rod is in the upper position corresponding to the open position of the open/close member.

FIG. 1 is a side view of a back part of a vehicle showing a general structure of this embodiment, FIGS. 2 and 3 are back views showing a left half of the back part of the vehicle, FIG. 4 is a side view of an actuating device as seen from an inside of the vehicle, FIG. 5 is a cross sectional view taken along a line V—V in FIG. 4, and FIGS. 6 and 7 are back views of the actuating device.

It is to be noted that a left side in FIG. 1, a depth direction in FIGS. 2 and 3, and a right side in FIG. 4 are regarded as "a forward direction" of the vehicle, while a right side in FIG. 1, a front side in FIGS. 2 and 3, and a left side in FIG.

4 are regarded as "a backward direction" of the vehicle. Moreover, a left to right direction in FIGS. 2 and 3 is regarded as "a lateral direction" of the vehicle.

A vehicle 1 has a rear gate 4 which forms an open/close member pivotally mounted to a backward end part of a roof 3 by means of a substantially horizontal hinge shaft 2 extending in a lateral direction. An opening 6 in a substantially trapezoidal shape as seen from the back is defined by a backward edge of the roof 3, and right and left vehicle body pillars 5 which form the back part of the vehicle. The rear gate 4 can be displaced within a range between a closed position in which the opening 6 is closed as shown by a solid line in FIG. 1, and in FIG. 2, and an open position in which the opening 6 is opened by lifting a backward end of the rear gate 4 as shown by a phantom line in FIG. 1, and in FIG. 3.

An actuating device 7 for displacing the rear gate 4 from the closed position to the open position, or from the open position to the closed position is provided on the vehicle body pillar at an inside of the vehicle body pillar 5, as shown mainly in FIGS. 2 and 3, near a connection part between a beam part 8 which is formed in a back and forth direction along a side face of the vehicle body and the vehicle body pillar 5, so that the device 7 may not protrude to a large extent from the vehicle body pillar 5 toward the opening 6.

As shown in FIGS. 2 and 3, the actuating device 7 includes a guide rail 9 which is fixed to the vehicle body pillar 5 at the inside of the vehicle as will be described below, in such a posture that its longitudinal direction is inclined toward a center of the opening 6 (an upper end of the guide rail is positioned more close to the center of the opening 6 than its lower end, in other words, positioned rightward in FIGS. 2 and 3), a rack 10 which is guided in the longitudinal direction of the guide rail 9, a motor unit 11 for moving the rack 10 along the longitudinal direction of the guide rail 9, and a connecting rod 12 which is connected at its upper end to an upper part of the rear gate 4 by means of a universal joint 12*a* which is rotatable in a desired direction, and connected at its lower end to an upper end of the rack 10 by means of a universal joint which is rotatable in a desired direction and formed as will be described below.

An engaging shaft 10*a* fixed to the upper end of the rack 10 and directed to the left to right direction is slidably engaged with a guide hole 9*a* which is provided in the guide rail 9, as shown in FIG. 4, thereby to guide the rack 10 in the longitudinal direction of the guide rail 9.

Moreover, the universal joint for connecting the lower end of the connecting rod 12 to the upper end of the rack 10 in this embodiment is formed by idly engaging the engaging shaft 10*a* which is fixed to the upper end of the rack 10 and passed through the guide hole 9*a* of the guide rail 9 with a through hole 12*e* which is formed in the lower end part of the connecting rod 12, in such a manner that the lower end of the connecting rod 12 can be rotated and inclined to the left to right direction with respect to the engaging shaft 10*a*. Alternatively, a universal joint similar to the universal joint 12*a* may be also employed.

The motor unit 11 has a motor 13 which is fixed to the vehicle body pillar 5 at the inside of the vehicle and adapted to be actuated by operating an operation switch provided near a driver's seat or another operating switch thereby to perform normal and reverse rotations, and a reduction system 14 which decelerates the rotation of the motor 13. The reduction system 14 has an output gear (not shown) which is meshed with a gear part 10*b* of the rack 10, and an electromagnetic clutch (not shown) for connecting and disconnecting a transmitting path between the motor 13 and the output gear.

The guide rail 9 is fixed at its upper end to the vehicle body pillar 5 at the inside of the vehicle by means of a bolt (not shown), and at the same time, fixed at its lower end to the reduction system 14 of the motor unit 11 which is fixed to the vehicle body pillar 5. Accordingly, the guide rail 9 is fixed to the vehicle body pillar 5 at the inside of the vehicle in a manner of extending along an inclined edge 5*a* of the vehicle body pillar 5 which defines a side edge of the opening 6. In this manner, the lower end of the guide rail 9 can be reliably fixed to the motor unit 11, enabling the rack 10 which is guided by the guide rail 9 to be reliably meshed with the output gear of the motor unit 11, and hence, the rack 10 can be reliably moved in the longitudinal direction of the guide rail 9.

In a substantially middle part of the connecting rod 12 in the longitudinal direction (in the vertical direction), there is formed a bent portion 12*d* which is bent in a substantially L shape. Due to this shape of the connecting rod 12, the connecting rod 12 can connect the rear gate 4 and the rack 10, as mainly shown in FIG. 2, in such a posture that in its lower position corresponding to the closed position of the rear gate 4 in which the connecting rod 12 is positioned in a lower part of the guide rail 9, a lower section 12*c* below the substantially middle part of the connecting rod 12 in the longitudinal direction may be inclined toward the center of the opening 6 with respect to the longitudinal direction of the guide rail 9, and at the same time, an upper section 12*b* above the middle part may be substantially in parallel to the longitudinal direction of the guide rail 9 and offset from a side face of the guide rail 9 directed to the center of the opening 6, by a determined amount, toward the center of the opening 6.

According to the above described structure, even though the connecting rod 12 has moved to its upper position corresponding to the open position of the rear gate 4 in which the connecting rod 12 is positioned in an upper part of the guide rail 9 as mainly shown in FIG. 3, the connecting rod 12 will never interfere with the inclined edge 5*a* of the vehicle body pillar 5. Accordingly, it will be possible to provide the guide rail 9 in such a manner that the guide rail 9 may not protrude from the vehicle body pillar 5 toward the opening 6 to a large extent, and hence, the appearance of the vehicle can be enhanced and an opening width of the opening 6 will not be made narrow.

In the closed position of the rear gate 4, when the operating switch is operated to open the rear gate 4, the motor 13 is controlled to perform the normal rotation, and the clutch of the reduction system 14 is magnetized thereby permitting the transmitting path between the motor 13 and the output gear to be connected. Then, the rack 10 is guided by the guide rail 9 and moved upward, following the rotation of the output gear of the motor unit 11. Along with the movement of the rack 10, the connecting rod 12 is moved from the lower position corresponding to the closed position of the rear gate 4 in which it is located in the lower part of the guide rail 9 as shown mainly in FIG. 2, to the upper position corresponding to the open position of the rear gate 4, as shown mainly in FIG. 3. Along with the movement of the connecting rod 12, the rear gate 4 will be displaced to the open position around the hinge shaft 2.

Following the opening displacement of the rear gate 4, the upper end of the connecting rod 12 (the upper universal joint 12*a*) moves upward straightly, while drawing a locus around the hinge shaft 2. Accordingly, the lower section 12*c* of the connecting rod 12 will become close to the inclined edge 5*a* of the vehicle body pillar 5 while it moves upward, as shown in FIG. 3. However, because the connecting rod 12 has the bent portion 12*d* in the substantially middle part in the longitudinal direction, the connecting rod 12 will not interfere with the inclined edge 5*a* of the vehicle body pillar 5, even though the rear gate 4 has been displaced to the open position.

On the other hand, in the open position of the rear gate 4, when the operating switch is operated to close the rear gate, the motor 13 is controlled to perform the reverse rotation, and the clutch is magnetized thereby permitting the rack 10 and the connecting rod 12 to move downward, and the rear gate 4 is rotated around the hinge shaft 2 to be displaced to the closed position.

According to the invention, the following advantages can be attained.

(a) It has become possible to arrange the guide rail on the vehicle body pillar without protruding toward the opening to a large extent, and therefore, the appearance can be enhanced and the opening width of the opening will not be made narrow.

(b) In addition to the above advantage, the lower end of the guide rail can be reliably fixed to the motor unit. In this manner, the rack can be reliably moved along the longitudinal direction of the guide rail by means of the motor unit.

What is claimed is:

1. An actuating device to open and close an open/close member of a vehicle which is pivotally mounted to an edge of an opening of said vehicle with a hinge shaft provided substantially horizontally, said actuating device comprising:

a guide rail arranged on a body pillar located on a side edge of said opening and configured so that a longitudinal direction of the guide rail is inclined toward a center of the opening;

a rack which is guided along the longitudinal direction of the guide rail;

a motor unit for moving the rack along the longitudinal direction of the guide rail; and a connecting rod which is connected at an upper end thereof to said open/close member by one joint and connected at a lower end thereof to said rack by another joint;

wherein said connecting rod is provided with a bent portion in a middle part thereof so that a lower section of said connecting rod below said middle part in a vertical direction is inclined with respect to the longitudinal direction of said guide rail, toward the center of said opening, and an upper section of said connecting rod above said middle part is substantially in parallel to the longitudinal direction of said guide rail and offset from a side face of said guide rail to the center of said opening, when said connecting rod is in a closed position of said open/close member.

2. The actuating device for the open/close member of the vehicle according to claim 1, wherein an upper end part of the guide rail is fixable to said body pillar, and a lower end part thereof is fixable to the motor unit which is fixed to said body pillar.

* * * * *